US005936581A

United States Patent [19]

Roshitsh et al.

[11] Patent Number: 5,936,581

[45] Date of Patent: Aug. 10, 1999

[54] RADIO FREQUENCY SWITCH ASSEMBLY

[75] Inventors: Todd W. Roshitsh, Coral Springs; Orlando Hernandez, Sunrise; Maureen M. Cook, Margate; Faris S. Habbaba; Raymond P. Meenen, Jr., both of Boca Raton, all of Fla.

[73] Assignee: Motorola, Inc., Schaumburg, Ill.

[21] Appl. No.: 08/811,060

[22] Filed: Mar. 3, 1997

[51] Int. Cl.[6] ..... H01Q 1/24

[52] U.S. Cl. ..... 343/702; 200/51.1; 343/906; 439/188; 439/916

[58] Field of Search ..... 343/702, 906; 439/916, 188; 200/51.1; H01Q 1/24, 1/50

[56] References Cited

U.S. PATENT DOCUMENTS 4,286,335 8/1981 Eichler et al. ..... 343/702
5,278,580 1/1994 Jaramillo et al. ..... 343/702
5,365,027 11/1994 Marvet et al. ..... 200/16
5,412,393 5/1995 Wiggenhorn ..... 343/702
5,562,464 10/1996 Lecourtois ..... 439/188

*Primary Examiner*—Michael C. Wimer
*Attorney, Agent, or Firm*—Andrew S. Fuller

[57] ABSTRACT

A radio frequency switch assembly (120) is mountable between an antenna port (110) and a detachable antenna (130) of a radio communication device assembly (100) to provide an interface for a radio frequency accessory. The switch assembly (120) has a radio interface port (123), a radio frequency accessory port (125), and an antenna interface port (127), and associated contacts (207, 216, 223). A mechanical switch alternatively interconnects the radio interface port (123) with the radio frequency accessory port (125) or with the antenna interface port (127). Preferably, the switch includes a conductive probe (213) that continuously engages the radio interface port contact (207) while being slidable to electrically interconnect with the antenna interface port contact (223) or with the radio frequency accessory port contact (216).

22 Claims, 3 Drawing Sheets

RADIO FREQUENCY SWITCH ASSEMBLY

TECHNICAL FIELD

This invention relates in general to switch assemblies, and particularly, to switch assemblies used in radio communication devices.

BACKGROUND

In communication devices, such as portable two-way radios, it is known to provide an externally accessible radio frequency (RF) accessory port for attaching remote antennas and other RF accessories. In one example, a radio has an RF port connected to the RF path of an integral antenna. An RF switch, internal to the radio, selectively switches the RF path from the integral antenna to the RF accessory port. Typically, the RF switch is automatically actuated when an accessory is connected to the RF accessory port. The prior art describes a variety of approaches for incorporating RF switches within a radio to support such functions.

One prior art approach is described in U.S. Pat. No. 5,278,570, issued to Jaramillo, et al., on Jan. 11, 1994, for a Combined Coaxial Connector and Radio Frequency Switch Assembly. In this approach, an antenna connector and RF switch assembly are integrated on a portable radio device. A switch, internal to the radio, is actuated when an external connector is attached to the housing. The switch is actuated by an external plunging mechanism that operates through an opening in the radio device housing. Another example is described in U.S. Pat. No. 5,365,027, issued to Marvet, et al., on Nov. 15, 1994, for a Slide Switch Assembly. Here, a switch assembly is surface mounted to a printed circuit board within a radio communication device. An associated external connector provides a port for attaching RF accessories. When an external accessory is connected to the connector, the accessory causes a plunger to be depressed thereby actuating the switch and rerouting RF signals from an antenna path to the accessory port. In both approaches, as typical in the art, the RF switch assembly is incorporated within the main body of the radio communication device. This design approach is used even though many radio users may not need an RF accessory port. As a result, unnecessary manufacturing costs are incurred which are ultimately borne by these users.

It is desirable to provide for the attachment of RF accessories to a radio when the need arises, and to provide for associated RF switching. However, the manufacturing expense and complexity associated with RF switches should be avoided unless needed by a particular user. Therefore, a new approach to the provision of RF switching to support external RF accessories is needed.

DETAILED DESCRIPTION OF THE PREFERRED EMBODIMENT

The present invention provides for an externally mountable radio frequency (RF) switch assembly for interfacing an accessory connector with a radio communication device. Preferably, the radio communication device has an antenna port for a detachable antenna and the switch assembly attaches to the antenna port. The RF switch assembly includes a radio interface port, an RF accessory port, and an antenna interface port. The radio interface port mounts on the antenna port of the radio communication device, and the detachable antenna is mountable to the antenna interface port. The RF accessory port is formed to receive an accessory connector. The RF switch assembly includes a mechanical switch that alternatively interconnects the radio interface port with the RF accessory port or with the antenna interface port. The switch includes contacts associated with the radio interface port, the antenna interface port, and the RF accessory port. A conductive member, preferably in the form of a probe having a retractable tip, is slidably biased against the radio interface port contact. In one position, the conductive member electrically interconnects the radio interface port contact with the antenna interface port contact, while being electrically disconnected from the RF accessory port. In another position, the conductive member electrically interconnects the radio interface port contact with the RF accessory port contact, while being electrically disconnected from the antenna interface port contact. Preferably, the RF accessory contact is movable to electrically engage and move the conductive member between the respective positions, thereby actuating the switch and interconnecting the radio interface port with the RF accessory port.

Figure 1:
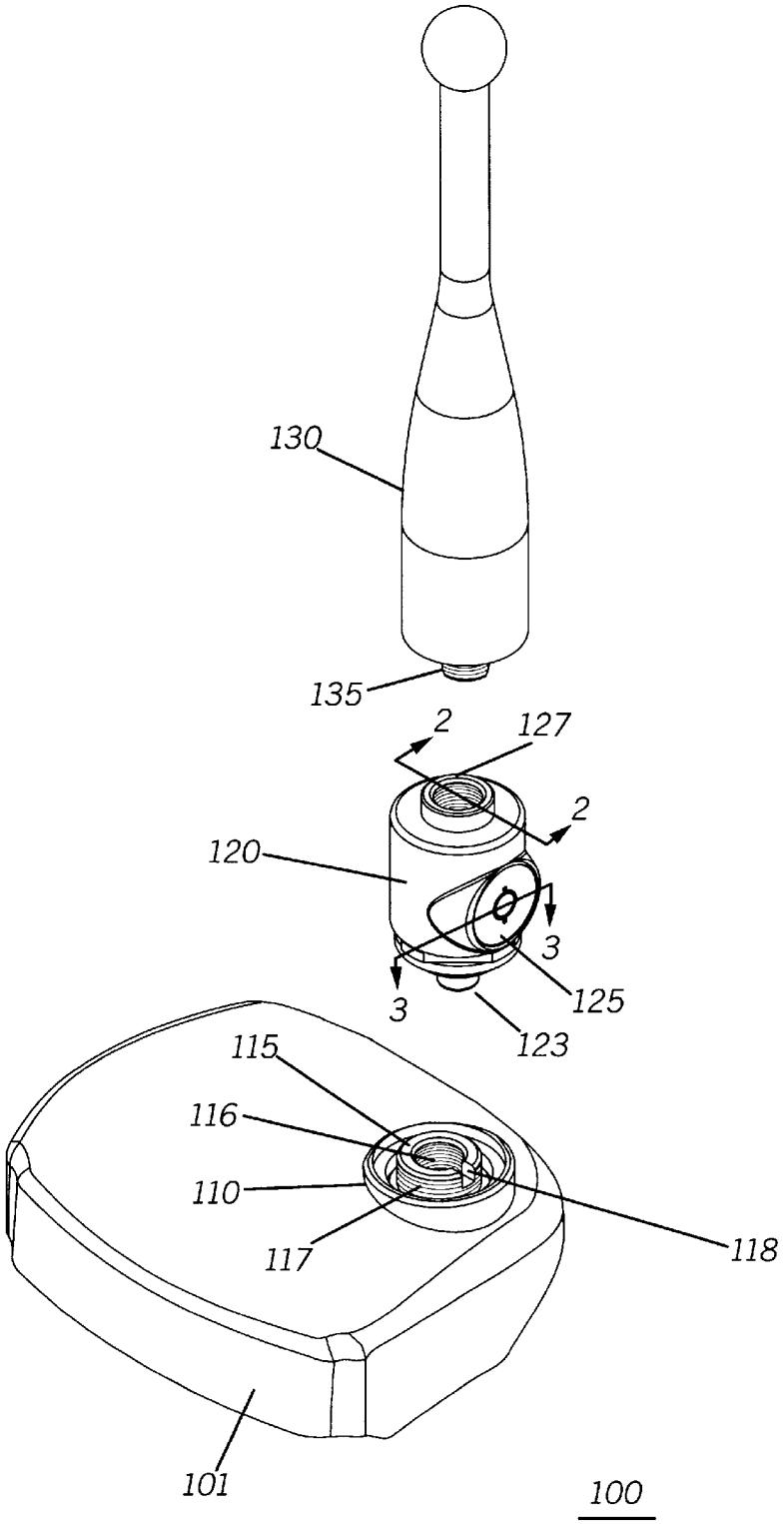
FIG. 1 is an exploded perspective view of a radio communication device having an externally mounted radio frequency switch assembly, in accordance with the present invention.

FIG. 1 shows an exploded fragmentary perspective view of a radio communication device assembly 100, in accordance with the present invention. The assembly 100 includes a radio 101, a switch assembly 120, and a detachable antenna 130. The radio 101 houses circuitry for conducting two-way communications over a wireless radio frequency channel. The radio 101 has an antenna port 110 that has a form factor to receive and secure a threaded portion 135 of the detachable antenna 130. The RF switch assembly 120 has a radio interface port 123 that attaches to the antenna port 110, and an antenna interface port 127 that receives and secures the detachable antenna 130. The RF switch assembly 120 also provides a radio frequency accessory port 125 to accommodate the connection of external accessories requiring access to the radio frequency signal path of the radio 101. In the radio assembly 100, the switch assembly 120 is interposed between the antenna port 110 and the detachable antenna 130. The antenna port 110 includes an antenna bushing 115 having internal and external threading 116, 117, and a key slot feature 118, that secures and properly orients the switch assembly 120. According to the present invention, the RF switch assembly 120 incorporates a mechanical switch that alternatively electrically interconnects the radio interface port 123, and thus the antenna port 110, with the radio frequency accessory port 125 or with the antenna interface port 127.

Figure 3:
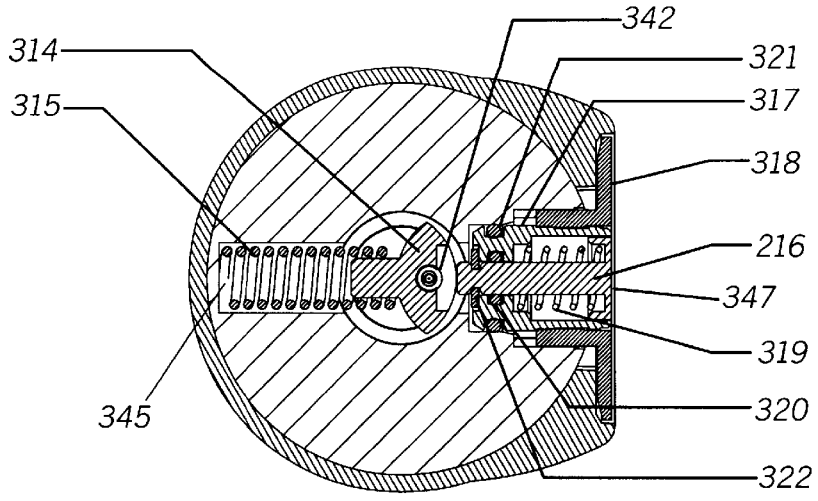
FIG. 3 is a cross-sectional view along the lines 3—3 of the switch assembly of FIG. 1 shown in an unswitched state, in accordance with the present invention.
Figure 2:
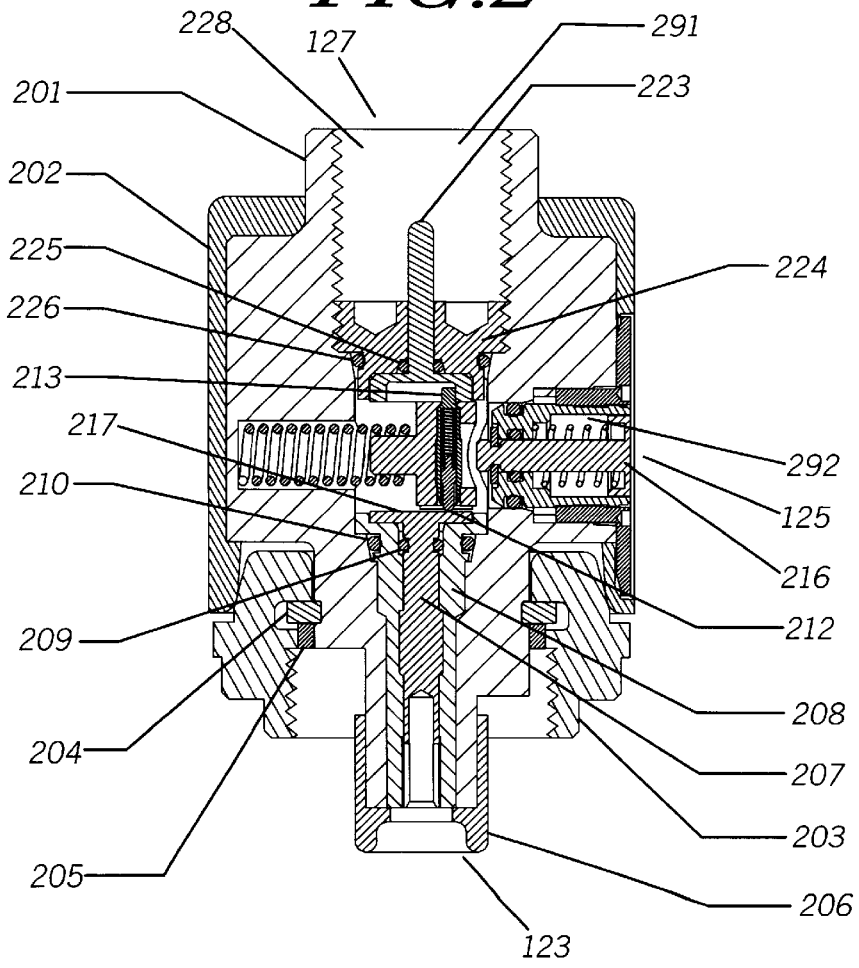
FIG. 2 is a cross-sectional view along the lines 2—2 of the switch assembly of FIG. 1 shown in an unswitched state, in accordance with the present invention.
Figure 4:
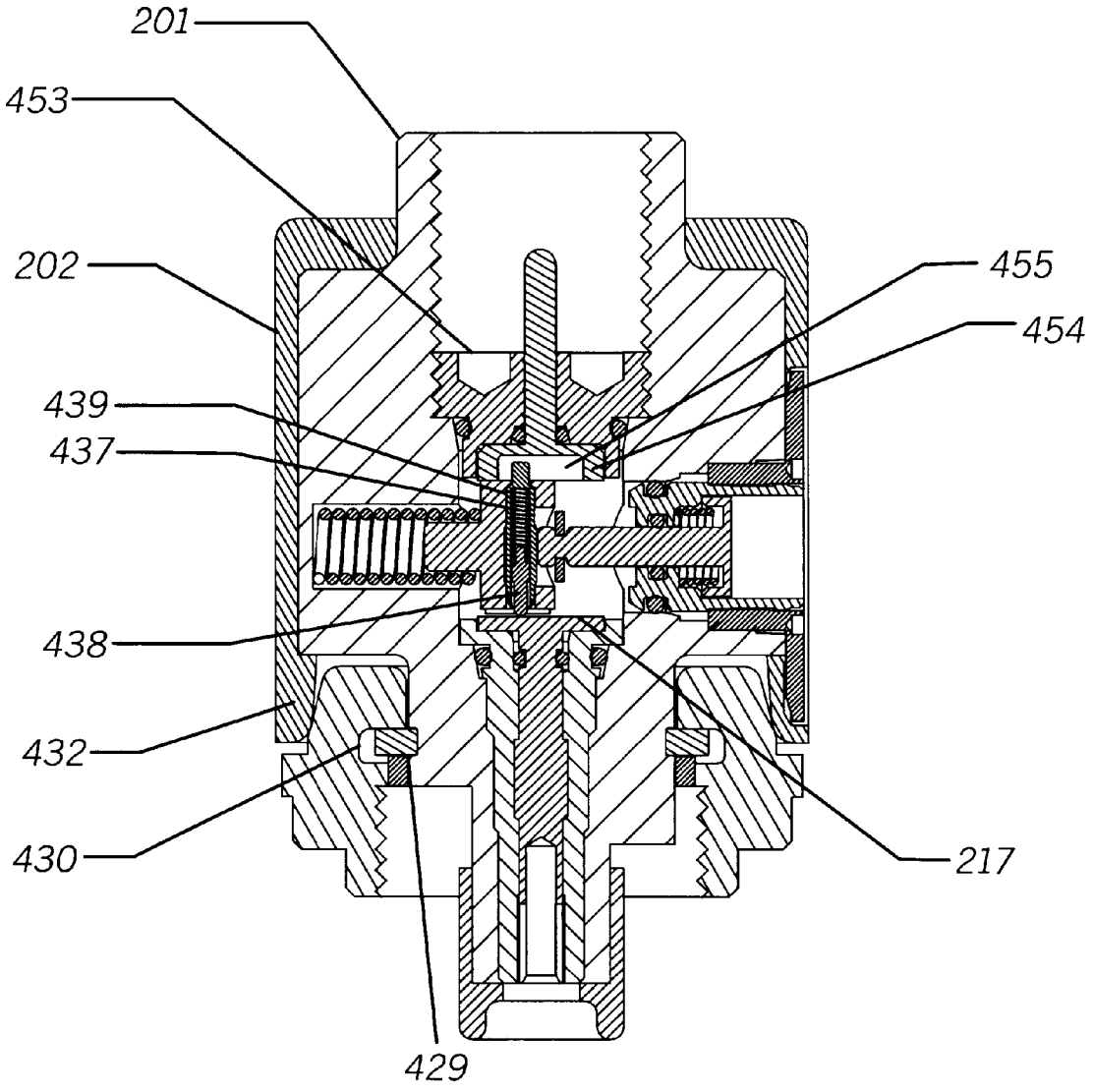
FIG. 4 is a cross-sectional view of the switch assembly as in FIG. 2 but shown in a switched state, in accordance with the present invention.

FIGS. 2 and 3 are cross-sectional views of the RF switch assembly 120 shown in an unswitched state, in accordance with the present invention. FIG. 4 is a cross-sectional view of the RF switch assembly 120 shown in a switched state, in accordance with the present invention. The RF switch assembly 120 of the preferred embodiment has elements which may be grouped for discussion purposes into a housing subassembly, a radio interface port subassembly, a switch subassembly, a radio frequency accessory port subassembly, and a antenna interface port subassembly.

The housing subassembly includes a housing 201 and a cosmetic casing 202. The housing 201 provides a frame or support structure for other components of the switch assembly 120. The housing 201 is preferably formed from metal using a standard metal cutting process such as employing a screw machine. The housing 201 has a longitudinal cavity 291 extending therethrough, and a cross-cut cavity 292, for inserting and housing the major switch components. The housing has openings to support the radio interface port 123, the antenna interface port 127, and the radio frequency accessory port 125. The cosmetic casing 202 is preferably formed from thermoplastic elastomer, such as polyurethane, and is overmolded onto the housing 201. The casing 202 may be textured for aesthetic purposes.

The radio interface port subassembly includes a socket 207, a socket insulator 208, a socket O-ring 209, a socket insulator O-ring 210, and a radio connector assembly 203, 204, 205, 206, which are assembled to the housing to form the radio interface port 123. The socket 207 extends from the radio interface port 123 into the housing 201 and terminates with a planar surface portion 217. Electrical isolation of the socket 207 from the housing 201 is provided by the socket insulator 208. The socket 207 forms a switch contact for the switching mechanism of the switch assembly 120.

The radio connector assembly includes a collar 203, a spiral retaining ring 204, a spacer ring 205, and a boot seal 206. The spiral retaining ring 204 is affixed to the housing 201, and is seated within an external groove 429 formed on the housing. The collar 203 has an internal groove 430 which fits around the spiral retaining ring 204 such that the collar 203 is captivated thereby. The collar 203 rotates freely about the housing 201. The collar 203 supports a grip tool for turning operations, and is threaded to mate with the antenna bushing 115 of the radio.

The spacer ring 205 is fitted unto the housing and is positioned within the collar. The spacer ring 205 limits flexural deformation of the spiral retaining ring when the switch assembly 120 is installed on the radio 101. As a result, the impact resistance of the assembly is significantly improved. The spacer ring 205 is preferably situated to ensure that a clamping force is developed on the housing. The overmolded casing 202 preferably has a flexible portion 432 that partially conceals the collar 203. The boot seal 206 fits around the housing 201 at the radio interface port 123 and provides for improved environmental sealing.

The antenna interface port subassembly includes an antenna pin 223, an antenna pin insulator 224, and O-rings 225, 226, which are assembled within a threaded cavity 228 of the housing 201 to form the antenna interface port 127. The threaded cavity 228 on the housing 201 forms a mount that receives and secures the threaded portion 135 of the antenna 130. During assembly, the antenna pin insulator 224 is fitted within the threaded cavity 228, and the antenna pin 223 is affixed to the insulator 224 in a press fit arrangement, such that the antenna pin 223 protrudes within the cavity 228. The O-ring 225 provides a seal for the interface between the antenna pin 223 and the insulator 224, and the O-ring 226 provides a seal between the insulator 224 and the housing 201. The perimeter of the insulator 224 is threaded to facilitate a screw-in assembly of the antenna interface output connector subassembly to the housing 201. Preferably, the insulator 224 is threaded in a complementary manner to the threaded cavity 228. Recesses 453 in the insulator 224 facilitates the transfer of torque to the antenna interface port subassembly, when the subassembly is screwed into the housing. Note that in this configuration, the components of the antenna interface port subassembly do not require a specific rotational orientation with respect to each other or with respect to the housing. The antenna pin 223 is formed to adapt to the antenna 130 when attached. The antenna pin 223 also includes an end portion having a sidewall 454 that form the perimeter of a recess 455. The antenna pin 223, particularly the sidewall 454, forms the antenna interface port contact which is an integral part of the switching mechanism of the switch assembly 120.

The switch subassembly includes a conductive probe 213, an insulator block 314, and a spring return member 315. In the preferred embodiment, the conductive probe 213 has a single-ended probe. The conductive probe 213 consists of a barrel 439, a probe pin 438 positioned in the barrel 439, and a coil spring member 437 anchoring the pin 438 to the barrel 439. The spring 437 and pin 438 are both captured within the barrel 439. This arrangement pre-loads the pin 438 while allowing the pin to move within the barrel. A portion 212 of the pin 438 extends outside the barrel 439 to form a retractable tip. The probe pin 438 is electrically connected to the barrel 439 throughout its range of motion. The probe 213 is mounted within the insulator block 314 such that the probe has opposing ends that protrude from the insulator block 314. An opening 342 within the insulator block 314 exposes the barrel of the probe to contact, at preferably a mid-portion, for switch actuation purposes. In this arrangement, the probe 213 is held in place by the insulator block 314 such that the probe tip 212 biasly engages the radio interface port contact 207 in an upright position along its planar surface 217.

The insulator block 314 is preferably formed from material, such as Teflon™-filled Delrin™, which offers a good combination of dielectric constant, machineability, and wear characteristics. The insulator block 314 is captured within the housing 201 between the radio interface port contact 207 and the antenna interface port contact 223, and is guided by the spring return member 315. The return spring member 315 is preloaded and housed within a nest hole 345 of the housing 201. The spring member 315 is positioned around the insulator block 314 to bias the insulator block 314 and the probe 213 away from the nest hole 345. The single-ended probe is arranged in an upright position relative to its contacts, and consequently has a small electrically conductive footprint, when compared to typical formed sheet-metal sliding contacts. The surrounding insulator block 314 effectively isolates the probe 213 from the surrounding metal of the housing internal bore. The insulator block 314 and probe 213 are normally biased by the spring return member 315, such that the probe 213 engages the antenna interface port contact 223, thereby electrically interconnecting the radio interface port contact 207 with the antenna interface port contact 223. The recess 455 accommodates the range of motion of the probe 213. The probe 213 is movable from a position engaging the sidewall 454 to a position within the recess removed from the sidewall 454.

The radio frequency accessory port subassembly includes a radio frequency accessory port contact in the form of a plunger 216, an insulator 317, a barrel 318, a return spring 319, O-rings 320, 321, and an e-clip 322. The plunger contact 216 is movable to engage with and disengage from the barrel 439 of the conductive probe 213. The return spring 319 is coupled to the plunger contact 216 and is preloaded to bias the plunger contact 216 to a resting position, thereby providing a switch actuation resistive force. The plunger contact 216 has an external surface 347 that together with the barrel 318 form an external interface for the radio frequency accessory port. The plunger contact 216 is separated from the barrel 318 by the insulator 317, which electrically isolates the plunger contact 216, and provides a smooth bore in which the plunger contact 216 is slidable. An inner O-ring 320 seals the interface between the plunger contact 216 and the insulator 317 throughout the plunger contact's range of travel. The e-clip 322 retains the preloaded plunger contact 216 within the insulator 317. An outer O-ring 321 seals the interface between the insulator 317 and the housing 201. The insulator 317 is retained to the barrel 318 by interference fit. The barrel 318 is threaded to facilitate a screw-in assembly to the housing 201. The threaded interface ensures good pressure contact and electrical connectivity between the barrel 318 and the housing 201. The components of the radio frequency accessory port subassembly do not require a specific rotational orientation with respect to each other or with respect to the housing.

Thus, the switch assembly incorporates a mechanical switch that includes the radio interface port contact 207, the antenna interface port contact 223, the radio frequency accessory port contact 216, and the conductive probe 213. The switch alternatively electrically interconnects the radio interface port 123 with the radio frequency accessory port 125 or with the antenna interface port 127. The radio interface port contact 207 and the antenna interface port contact 223 are fixed in a spaced apart relationship, relative to each other, while the radio frequency accessory port contact 216 is movable relative to the other contacts 207, 223 between a position engaging the conductive probe 213 and a position disengaged or spaced apart from the conductive probe 213. When disengaged from the radio frequency accessory port contact 216, the conductive probe 213 is biased to interconnect the radio interface port contact 207 with the antenna interface port contact 223. When engaged by a switch actuating force, the conductive probe slides along while continuously engaging the radio interface port contact 207, and is disconnected from the antenna interface port contact 223. Simultaneously, the conductive probe 213 electrically interconnects the radio interface port contact 207 with the radio frequency accessory port contact 216. The switch is normally biased to interconnect the radio interface port 123 with the antenna interface port 127, and is automatically actuated to interconnect the radio interface port 123 with the radio frequency accessory port 125 when an accessory connector (not shown) is mated with the radio frequency accessory port 125.

According to one aspect of the present invention, a single-ended probe assembly is used in a novel manner. One portion of the probe, i.e., the probe tip, continually slidably engages the radio interface port contact. Another portion of the probe, i.e., the end opposite the probe tip, selectively engages the antenna interface contact, depending on the position of the probe. The probe is engaged by the radio frequency accessory port contact in a controllable, periodic manner, at preferably the midpoint of the barrel. The retractable or deflectable probe pin, meanwhile, remains in continuous contact with a contact surface. Hence, the single-ended probe assembly is used to provide a double-throw, single-break action. One benefit of the sliding probe approach is the reduced space requirements compared to other approaches.

The present invention provides significant advantages over the prior art. An externally mountable switch assembly interfaces with an antenna port on a communication device and provides radio frequency switching to support attached radio frequency accessories. This allows for the avoidance of manufacturing expense associated with radio frequency switches unless required by a particular user. The switch assembly incorporates a mechanical switch that is implemented within tight spatial boundaries, but that provides reliable functionality.

What is claimed is:

1. A radio assembly, comprising:

a detachable antenna;

a radio having an externally accessible antenna port with a mount to receive and secure the detachable antenna; and a switch assembly externally mounted to the radio inbetween the antenna port and the detachable antenna, the switch assembly comprising:

a radio interface port having a mount that mates with the mount of the antenna port;

an antenna interface port having a mount that receives and secures the detachable antenna;

a radio frequency accessory port; and a mechanical switch that alternatively electrically interconnects the antenna port with the radio frequency accessory port or with the detachable antenna.

2. The radio assembly of claim 1, wherein the switch has a double-throw, single-break action.

3. The radio assembly of claim 1, wherein the switch comprises:

first, second, and third contacts having a spaced apart relationship; and a conductive member slidably engaged with the first contact between first and second positions, wherein when in the first position, the conductive member electrically interconnects the first contact with the second contact but not with the third contact, and when in the second position, the conductive member electrically interconnects the first contact to the third contact but not to the second contact.

4. The radio assembly of claim 3, wherein the first, second, and third contacts are electrically connected to the radio interface port, the radio frequency accessory port, and the antenna interface port, respectively.

5. The switch assembly of claim 4, wherein:

the first and third contacts are fixed relative to each other, and the second contact is movable relative to the first and third contacts between a position engaging the conductive member and a position disengaged from the conductive member; and the conductive member is biased in the second position when disengaged from the second contact, and biased in the first position when engaged by the second contact with a particular switch actuating force.

6. The switch assembly of claim 3, wherein the conductive member comprises a single-ended probe positioned to biasly engage the first contact.

7. The switch assembly of claim 6, wherein the single-ended probe comprises a barrel, a pin positioned within the barrel, and a spring member anchoring the pin to the barrel, the pin and barrel having constant electrical contact.

8. The switch assembly of claim 7, wherein the pin is biasly engaged with the first contact by the spring member, and the second contact interfaces with the barrel when engaging the conductive member.

9. A radio frequency switch assembly, comprising:

first, second, and third contacts having a spaced apart relationship; and a conductive probe movable between first and second spaced-apart positions on the first contact, wherein when in the first position, the conductive probe electrically interconnects the first contact with the second contact but not with the third contact, and when in the second position, the conductive probe electrically interconnects the first contact to the third contact but not to the second contact;

wherein the conductive probe is positioned to physically slide along surface of the first contact while continuously engaging the first contact when the conductive probe is moved between the first and second positions.

10. The radio frequency switch assembly of claim 9, wherein the conductive probe has a retractable tip.

11. The radio frequency switch assembly of claim 10, wherein the conductive probe comprises a barrel, a pin positioned within the barrel, and a spring member anchoring the pin to the barrel, the pin and barrel having constant electrical contact.

12. The radio frequency switch assembly of claim 9, wherein:

the first and third contacts are fixed relative to each other, and the second contact is movable relative to the first and third contacts between a position engaging the conductive probe and a position disengaged from the conductive probe; and the conductive probe is biased in the second position when disengaged from the second contact, and biased in the first position when engaged by the second contact with a particular switch actuating force.

13. An externally mountable radio frequency switch assembly for interfacing an accessory connector with a radio communication device, the radio communication device having an antenna port with a mount for receiving and securing a detachable antenna, the radio frequency switch assembly comprising:

a radio interface port having a mount with a form factor for mating with the mount of the antenna port in a detachable manner;

a radio frequency accessory port that receives the accessory connector;

an antenna interface port having a mount that receives and secures the detachable antenna; and a mechanical switch that alternatively interconnects the radio interface port with the radio frequency accessory port or with the antenna interface port.

14. The radio frequency switch assembly of claim 13, wherein the switch is normally biased to interconnect the radio interface port with the antenna interface port, and is automatically actuated to interconnect the radio interface port with the radio frequency accessory port when the accessory connector is mated with the radio frequency accessory port.

15. The radio frequency switch assembly of claim 14, wherein the switch comprises:

first, second, and third contacts having a spaced apart relationship, and that are electrically connected to the radio interface port, the radio frequency accessory port, and the antenna interface port, respectively; and a conductive member movable between first and second positions while engaging the first contact, wherein when in the first position, the conductive member electrically interconnects the first contact with the second contact but not with the third contact, and when in the second position, the conductive member electrically interconnects the first contact to the third contact but not to the second contact.

16. The radio frequency switch assembly of claim 15, wherein the conductive member slidably engages the first contact while moving between the first and second positions.

17. The radio frequency switch assembly of claim 16, wherein the conductive member comprises a retractable probe biased against the first contact.

18. The radio frequency switch assembly of claim 17, wherein the retractable probe comprises a barrel, a pin positioned within the barrel, and a spring member anchoring the pin to the barrel, the pin and barrel having constant electrical contact.

19. The radio frequency switch assembly of claim 16, wherein:

the first and third contacts are fixed relative to each other, and the second contact is movable relative to the first and third contacts between a position engaging the conductive member and a position disengaged from the conductive member; and the conductive member is biased in the second position when disengaged from the second contact, and biased in the first position when engaged by the second contact with a particular switch actuating force.

20. A radio frequency switch assembly for interfacing an accessory connector with a radio communication device, the radio communication device having an antenna port with a mount for a detachable antenna, the radio frequency switch assembly comprising:

a radio interface port having a mount with a form factor for mating with the mount of the antenna port in a detachable manner;

a radio frequency accessory port that receives the accessory connector;

an antenna interface port having a mount that receives and secure the detachable antenna;

a switch, comprising:

a first contact electrically interconnected to the radio interface port;

a second contact spaced apart from the first contact, the second contact being electrically interconnected to the antenna interface port;

a probe having a retractable tip biased against the first contact, the probe being movable between first and second positions while sliding along the first contact, wherein when in the first position, the probe electrically interconnects the first contact with the second contact, and when in the second position, the probe is electrically disconnected from the second contact, the probe being normally biased in the first position; and a plunger contact electrically interconnected to the radio frequency accessory port, the plunger contact being normally biased in a position away from the probe and movable to electrically engage the probe, and to move the probe to the second position.

21. The radio frequency switch assembly of claim 20, wherein the probe comprises a barrel, a pin positioned within the barrel, and a spring member anchoring the pin to the barrel, the pin and barrel having constant electrical contact.

22. The radio frequency switch assembly of claim 20, wherein the plunger contact has an interface at the radio frequency accessory port.

* * * * *